US009067654B2

(12) United States Patent
Lessing

(10) Patent No.: US 9,067,654 B2
(45) Date of Patent: Jun. 30, 2015

(54) WATER CRAFT LEASH

(71) Applicant: PJ WHIT PTY LTD, Williamstown, Vic (AU)

(72) Inventor: Christiaan Stefanus Lessing, Altona (AU)

( * ) Notice: Subject to any disclaimer, the term of this patent is extended or adjusted under 35 U.S.C. 154(b) by 0 days.

(21) Appl. No.: 14/078,496

(22) Filed: Nov. 12, 2013

(65) Prior Publication Data

US 2014/0141668 A1 May 22, 2014

Related U.S. Application Data

(60) Provisional application No. 61/727,741, filed on Nov. 18, 2012.

(51) Int. Cl.
*B63B 1/00* (2006.01)
*B63B 35/00* (2006.01)
*B63B 35/79* (2006.01)

(52) U.S. Cl.
CPC ..... *B63B 35/7933* (2013.01)

(58) Field of Classification Search
CPC .. B63B 35/79; B63B 35/7933; B63B 35/7993
USPC ..... 441/65, 74, 75
See application file for complete search history.

(56) References Cited

U.S. PATENT DOCUMENTS

| | | | | | |
|---|---|---|---|---|---|
| 3,931,656 | A * | 1/1976 | Thomson | 441/75 |
| 4,044,415 | A * | 8/1977 | Wood | 441/75 |
| 5,324,220 | A * | 6/1994 | Stewart | 441/75 |
| 5,490,805 | A * | 2/1996 | Bredesen | 441/75 |
| 5,738,556 | A * | 4/1998 | Palmieri | 441/75 |
| 5,775,965 | A * | 7/1998 | Hango | 441/75 |
| 6,000,979 | A * | 12/1999 | Stewart | 441/75 |
| 6,500,039 | B1 * | 12/2002 | Underwood | 441/75 |
| 8,894,457 | B1 * | 11/2014 | Crozier | 441/75 |

* cited by examiner

*Primary Examiner* — Daniel V Venne
(74) *Attorney, Agent, or Firm* — Louis Ventre, Jr.

(57) ABSTRACT

A leash for a recreational water craft has a body attachment section and a rope. The rope has a more elastic rope section and a less elastic rope section connected end to end. The more elastic and less elastic rope sections are tethered through outer ends to the body attachment section. The less elastic rope section is longer than the more elastic rope section in a non-stretched state and is tethered to the craft in use through a craft rope sliding element. The less elastic rope section has a blocking element preventing passage through the craft rope sliding element. When the body attachment section is pulled away from the craft, the more elastic rope section expands, allowing the less elastic rope section to slip through the craft rope sliding element.

10 Claims, 2 Drawing Sheets

WATER CRAFT LEASH

CROSS-REFERENCE TO RELATED APPLICATION

This application claims the benefit of U.S. Provisional Application No. 61/727,741, filed 18 Nov. 2012, which is hereby incorporated by reference herein.

TECHNICAL FIELD

In the field of buoys, rafts, and aquatic devices, an improved leash for a recreational water craft, such as a bodyboard, is disclosed.

BACKGROUND ART

There are many types of small personal watercraft such as bodyboards, surfboards and the like that children and adults alike enjoy, particularly in an informal swimming situation at the seaside or in a pool. Wrist leashes are known which attached to the front of the board and which are primarily for attaching to the wrist so that the board will not escape too far from the swimmer when the swimmer falls off the board, but are inevitably used to tow the craft when playing together. Most wrist leashes comprise a polyurethane elastic section made of helically coiled plastic that when tugged past a non-elastic point, as typically occurs during towing games, will become damaged or break, often injuring the swimmers. Purpose built tow ropes are known, made from non-elastic tough nylon cord, but towing with these is less fun than with the fragile elastic cords, which store energy and produce the sensation of a power burst through the water.

There is therefore a need to provide an improved leash which is protected from damage but still serves to provide the elastic energy storage.

SUMMARY OF INVENTION

According to a first broad aspect of the invention there is provided a leash for a recreational water craft, the leash comprising a body attachment section and a rope. The rope includes a more elastic rope section and a less elastic rope section connected end to end. The more elastic and less elastic rope sections each are tethered through outer ends thereof to the body attachment section. The less elastic rope section is longer than the more elastic rope section in a non-stretched state and is tethered to the craft in use through a craft rope sliding element in sliding engagement. The less elastic rope section includes a blocking element disposed on an opposite side of the craft rope sliding element from its outer end, sized and shaped so that the blocking element does not pass through the craft rope sliding element in use. When the body attachment section is pulled away from the craft, the more elastic rope section elastically expands, which allows the less elastic rope section to slip through the craft rope sliding element, tending to equalize forces conveyed through the more and less elastic rope sections, until the blocking element engages with the craft rope sliding element after which additional forces are conveyed through the less elastic rope section.

The craft rope sliding element may optionally be in a sliding engagement with a craft tether rope attached to the craft at both ends. The more elastic rope section may include a coiled spring of plastic material such as polyurethane. The less elastic rope section may be substantially inelastic and comprises a plastic rope or cord which may be made from nylon. The body attachment section may include a handle for towing and the less elastic rope section may have an end to end length appropriate for towing, such as for example, between 0.5 and 2 meters. Optionally, the body attachment section is a wrist strap.

According to a second broad aspect of the invention there is provided a recreational water craft with the leash of the first broad aspect.

According to a third broad aspect of the invention there is provided a bodyboard with the leash of the first broad aspect.

DESCRIPTION OF EMBODIMENTS

An embodiment of the current invention will now be described.

Figure 1A:
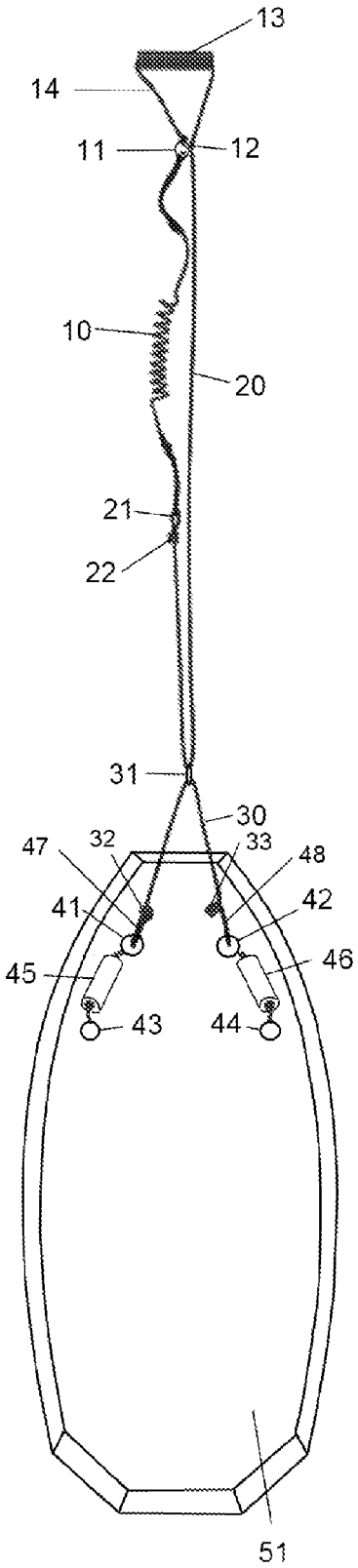
FIGS. 1*a* and 1*b* are top and bottom views respectively of a bodyboard incorporating the leash according to an embodiment of the invention.
Figure 1B:
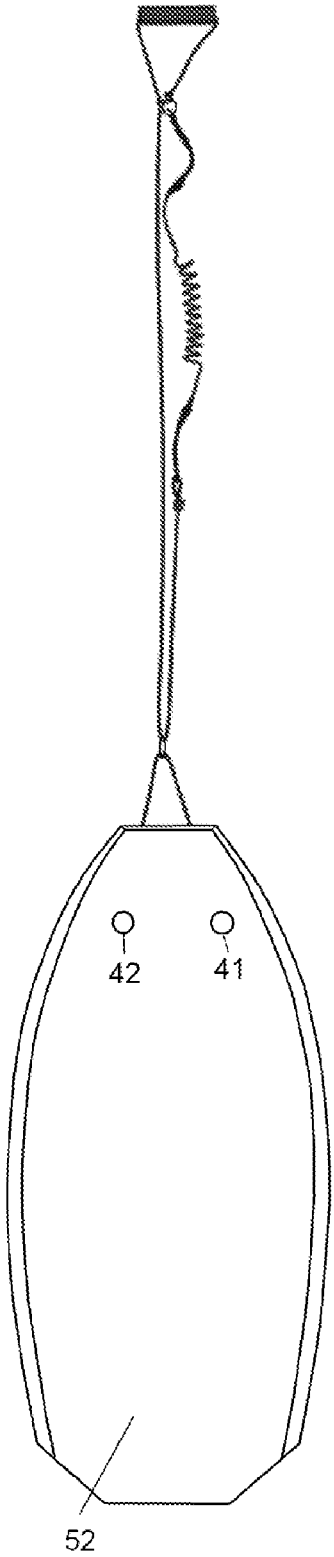

Referring FIGS. 1*a* and 1*b*, a water craft in the form of a bodyboard with top surface 51 and bottom surface 52 is shown with a leash according to an embodiment of the first aspect of the invention.

Figure 2:
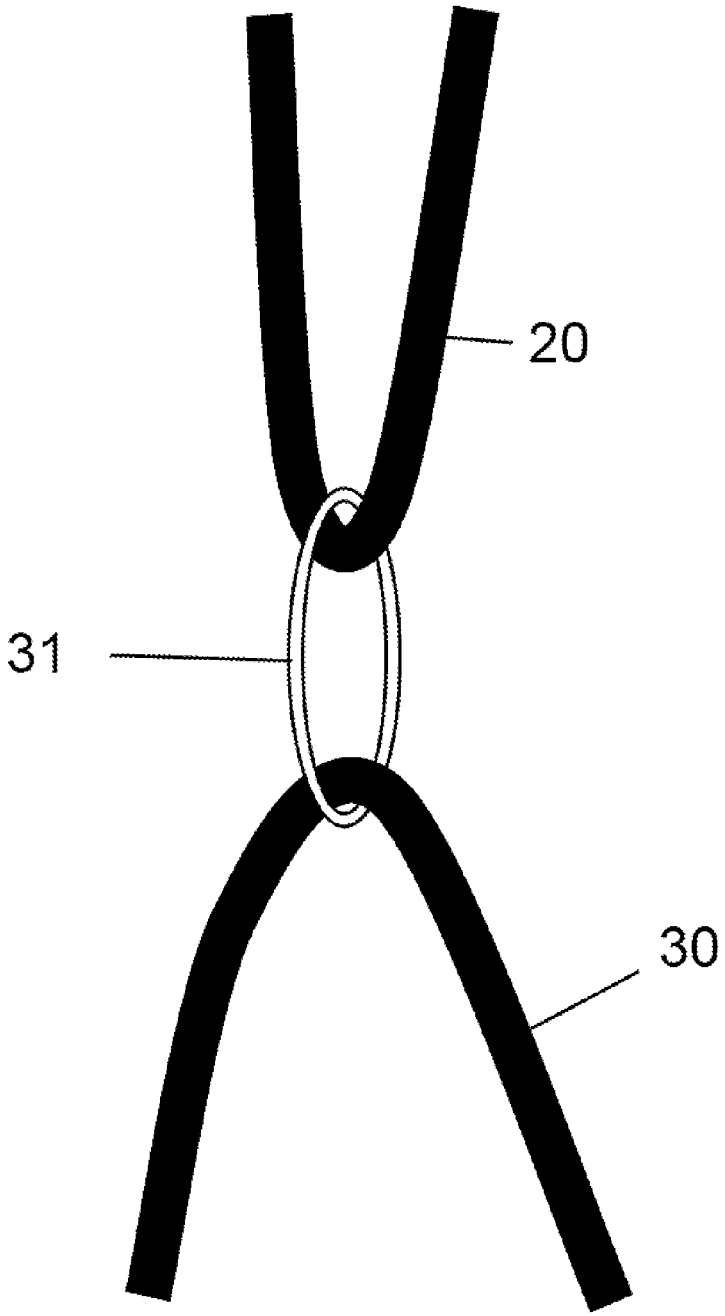
FIG. 2 shows detail in the vicinity of craft rope sliding element 11 for the embodiment of FIG. 1.

The embodiment described is appropriate for use as a tow rope for the bodyboard, and accordingly the body attachment section 13, 11, 14 comprises a handle 13. Handle 13 is attached on one end to a 5 mm nylon cord, being an outer end of a less elastic rope section 20 of the leash. Less elastic rope section 20 is tied to metal ring 11. Less elastic rope section 20 also passes in sliding engagement through a craft rope sliding element 31 in the form of a metal slip ring, shown in more detail in FIG. 2.

Less elastic rope section 20 terminates in a loop 21 which is tied end to end to a helically coiled more elastic rope section 10, which in turn is secured at its outer end to ring 11. More elastic rope section 10 is constructed from polyurethane and may be essentially the same as is found in an elastic prior art coiled wrist leash. Ring 11 is also secured to the other end of the handle 13 by a short rope section 14.

Secured on less elastic rope section 20 near loop 21 is a blocking element 22 in the form of a plastic annular shaped piece, sized and shaped so as not to pass through craft rope sliding element 31 in use. Also passing through metal slip ring 31 in sliding engagement is a craft tether rope 30 with end elements 32 and 33 that removably engage through loops 47 and 48 attached to plastic plugs 41 and 42 extending through the bodyboard.

The bodyboard top surface 51 also has swimmer handles 45 and 46 attached across plastic plugs 41 and 42 respectively and further plugs 43 at 44 respectively.

In use, the leash is first attached to the bodyboard by passing and elements 32 and 33 through their respective loops 47 and 48 on the bodyboard. When a person wishes to tow a swimmer along the water's surface, person pulls on handle 13. As the handle is pulled away from the bodyboard, the more elastic rope section 10 expands, allowing the less elastic rope section 20 to slip through craft rope sliding element 31 tending to equalize forces conveyed through more elastic rope section 10 and less elastic rope section 20. As the person pulls harder, the slipping proceeds until the blocking element 22 engages with craft rope sliding element 31, preventing further slippage. After this point, any additional pulling force is conveyed only through the less elastic rope section 20, protecting the fragile more elastic rope section 22 from breakage.

In this embodiment, with the craft rope sliding element 31 also in sliding engagement with craft tether rope 30, if the board is pulled in different directions, craft tether rope 30 slips through metal slip ring 31 to equalise the forces transmitted through end elements 32 and 33 respectively, reducing the likelihood of damage to plugs 41 and 42 and the surrounding board material.

Persons skilled in the art will also appreciate that many variations may be made to the invention without departing from the scope of the invention.

For example, the materials of polyurethanes and nylon cord disclosed in the embodiment described are exemplary only and may be replaced by other appropriate materials for particular application envisaged. Further, craft rope sliding element 31 is not necessarily a metal slip ring and in other embodiments may be a loop directly attached to the bodyboard or even a roller wheel, provided that the sliding engagement is retained with respect to the less elastic rope section so as to allow equalization of the forces until the blocking element engages. Further still, while the embodiment described is appropriate for a tow rope, other embodiments may be adapted to a wrist leashes, for which the body attachment section is typically a strap to be bound around the swimmer's wrist.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention. Further, any method steps recited in the claims are not necessarily intended to be performed temporally in the sequence written, or to be performed without pause once started, unless the context requires it.

It is to be understood that, if any prior art publication is referred to herein, such reference does not constitute an admission that the publication forms a part of the common general knowledge in the art, in Australia or any other country.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

What is claimed is:

1. A leash for a recreational water craft, the leash comprising:

a craft rope sliding element;

a body attachment section; and a rope, the rope comprising a more elastic rope section and a less elastic rope section connected end to end;

the less elastic rope section configured to tether to the recreational water craft through the craft rope sliding element in sliding engagement;

the more elastic rope section and less elastic rope section each being tethered through respective outer ends thereof to the body attachment section;

the less elastic rope section being longer than the more elastic rope section in a non-stretched state of the more elastic rope section;

the less elastic rope section comprising a blocking element disposed on an opposite side of the craft rope sliding element from the outer end of the less elastic rope section, which is configured to preclude passage through the craft rope sliding element; and whereby when the craft rope sliding element is attached to the recreational water craft and the body attachment section is pulled away from the recreational water craft, the more elastic rope section is adapted to elastically expand and the less elastic rope section is adapted to slip through the craft rope sliding element until the blocking element engages with the craft rope sliding element.

2. The leash of claim 1, further comprising a craft tether rope adapted to slidably engage with the craft rope sliding element; the craft tether rope configured to attach to the recreational water craft at both ends of the craft tether rope.

3. The leash of claim 1, wherein the more elastic rope section comprises a coiled spring of plastic material.

4. The leash of claim 3, wherein the plastic material is polyurethane.

5. The leash of claim 1, wherein the less elastic rope section is substantially inelastic and comprises a plastic rope or cord.

6. The leash of claim 5, wherein the plastic rope or cord is made from nylon.

7. The leash of claim 1, further comprising a handle on the body attachment section, the handle usable for towing; and wherein the less elastic rope section has an end to end length appropriate for towing of between 0.5 and 2 meters.

8. The leash of claim 1, wherein the body attachment section is a wrist strap.

9. A recreational water craft comprising the leash of claim 1.

10. A bodyboard comprising the leash of claim 1.

* * * * *